US005376193A

United States Patent [19]

Bendersky

[11] Patent Number: 5,376,193

[45] Date of Patent: Dec. 27, 1994

[54] INTERMETALLIC TITANIUM-ALUMINUM-NIOBIUM-CHROMIUM ALLOYS

[75] Inventor: Leonid A. Bendersky, Gaithersburg, Md.

[73] Assignee: The United States of America as represented by the Secretary of Commerce, Washington, D.C.

[21] Appl. No.: 81,800

[22] Filed: Jun. 23, 1993

[51] Int. Cl.[5] ..... C22C 14/00

[52] U.S. Cl. ..... 148/421; 148/671; 420/421

[58] Field of Search ..... 148/421, 671; 420/421

[56] References Cited

U.S. PATENT DOCUMENTS

| | | | |
|---|---|---|---|
| 4,292,077 | 9/1981 | Blackburn et al. | 148/421 |
| 4,842,819 | 6/1989 | Huang et al. | 420/418 |
| 4,879,092 | 11/1989 | Huang et al. | 420/418 |
| 4,916,028 | 4/1990 | Huang et al. | 428/614 |
| 4,983,357 | 1/1991 | Mitso et al. | 420/418 |
| 4,990,308 | 2/1991 | Jackson | 420/426 |
| 5,019,334 | 5/1991 | Jackson | 420/426 |
| 5,032,357 | 7/1991 | Rowe | 420/418 |
| 5,076,858 | 12/1991 | Huang | 420/427 |
| 5,080,860 | 1/1992 | Huang | 420/418 |
| 5,114,505 | 5/1992 | Mirchandani et al. | 148/437 |
| 5,185,045 | 2/1993 | Peters et al. | 148/421 |
| 5,205,984 | 4/1993 | Rowe | 420/418 |

OTHER PUBLICATIONS

Rowe, "Recent Developments In Ti-Al-Nb Titanium Aluminide," (C. T. Liu et al., eds), *High Temperature Aluminides and Intermetallics,* TMS-AIME, Warrendale Ohio, 375-401 (1990).

Izumi, ed., Proceedings of International Symposium on Intermetallic Compounds—Structure and Mechanical Properties, The Japan Institute of Metals, pp. 363-370, 531-536, 753-762, 851-855 (1991).

Banerjee et al., "A New Ordered Orthorhombic Phase In A $Ti_3Al$-Nb Alloy," *Acta. Metall.,* 36 (4), 871-882 (1988).

Bendersky et al., "The Formation Of Ordered-ω-Related Phases In Alloys Of Composition $Ti_4Al_3Nb$," *Acta Metall.,* 38 (6), 931-943 (1990).

Bendersky et al., "Intermetallic Ti-Al-Nb Alloys Based On Strengthening Of The Orthorhombic Phase By ω-Phases," *Mat. Sci. Eng.,* A152, 41-47 (1992).

Bendersky et al., "Investigation Of B2 And Related Phases In The Ti-Al-Nb Ternary System," *Proc. Mater. Res. Soc. Symp.,* 133 45-50 (1989).

*Primary Examiner*—Upendra Roy

*Attorney, Agent, or Firm*—Leydig, Voit & Mayer, Ltd.

[57] ABSTRACT

Novel Ti-Al-Nb-Cr alloys incorporating in their microstructure the hexagonal $DO_{19}$ phase, the omega-type $B8_2$ phase, the cubic B2 phase, and, optionally, the orthorhombic O phase. The intermetallic alloys consist essentially of, in atomic percent, about 48-62% Ti, about 28-32% Al, and about 10-20% Nb with Cr, wherein Cr is preferably present at about 4-16% of the total concentration.

19 Claims, 3 Drawing Sheets

INTERMETALLIC TITANIUM-ALUMINUM-NIOBIUM-CHROMIUM ALLOYS

TECHNICAL FIELD OF THE INVENTION

The invention pertains to novel, low density titanium-aluminum-niobium-chromium alloys. The microstructure of these alloys consist of at least three, and preferably four, phases. These heterophase alloys possess superior combinations of room and high temperature mechanical properties.

BACKGROUND OF THE INVENTION

There is currently great interest in titanium aluminide (Ti aluminide) compounds possessed of low density and high strength relative to other available alloys. This interest is due to the continuous creation of new applications for these alloys, for example in the aerospace industry. These new applications generate an ever-increasing need for low density structural materials of high temperature strength, tolerable low temperature ductility, and reasonable oxidation resistance. This need of the industries drives ongoing research attempts to improve the titanium aluminide compounds. Since the microstructure of an intermetallic alloy affects its physical properties, these improvement attempts have focused on altering the microstructure of titanium aluminide compounds. The intermetallic phases $\alpha_2$-$Ti_3Al$ ($DO_{19}$) and $\gamma$-TiAl ($Ll_0$) have been extensively exploited for this purpose.

There are primarily two approaches that have been used in the development of improved titanium aluminide compounds. In the first approach, binary microstructures composed of $DO_{19}$ and $Ll_0$ phases have been altered by adding small quantities of elements which modify phase boundaries and properties (U.S. Pat. No. 4,983,357; Proceedings of International Symposium on Intermetallic Compounds -Structure and Mechanical Properties, ed. O. Izumi, The Japan Institute of Metals (1991)).

In the second approach, niobium (Nb) has been added to increase plasticity of the $DO_{19}$ phase, and to form microstructures combining the $DO_{19}$ phase with $\beta$(BCC)/B2 phases in the Ti-Al-Nb system (U.S. Pat. No. 4,292,077; R.G. Rowe in *High Temperature Aluminides and Intermetallics*, (C.T. Liu et al., eds) TMS-AIME, Warrendale OH, 375 (1990); Proceedings of International Symposium on Intermetallic Compounds—Structure and Mechanical Properties, ed. 0. Izumi, The Japan Institute of Metals (1991)). Using this latter approach, alloys approaching a composition consisting in atomic percent of 24% aluminum, 11% niobium, and balance titanium were found to possess very promising combinations of specific strength and rupture life at temperatures less than 800° C.

Within the Ti-Al--Nb system, an ordered ternary $Ti_2AlNb$ (0) phase was recently discovered that may have potential as a structural material for use at elevated temperature (D. Banerjee et al. *Acta. Metal.*, 36, 871 (1988)). This O phase has orthorhombic symmetry (Cmcm) which occurs by Ti/Nb ordering of the hexagonal $DO_{19}$ phase, or by Al/Nb ordering of the cubic B2 phase. Alloys with microstructures consisting of the O and $\beta$ (BCC)/B2 phases have been shown to possess excellent combinations of room and high temperature mechanical properties (U.S. Pat. No. 5,032,357). These alloys consist in atomic percent of 18–30% Al, 18-34% Nb, and balance Ti.

Another ternary phase in the Ti-Al-Nb system was also recently discovered. This phase is close in composition to $Ti_4Al_3Nb$. The ternary phase is in apparent equilibrium with the $Ll_0$, $DO_{19}$ and orthorhombic O phases (Bendersky et al., *Acta Metall.*, 38, 931 (1990); Bendersky et al., *Mat. Sci. Eng.*, *A*152, 41 (1992)). The phase has the $B8_2$ structure of the omega-type phases (Bendersky et al., *Acta Metall.*, 38, 931 (1990)). It forms readily at high temperature from the cubic B2 phase by displacement of pairs of 111 planes and subsequent chemical ordering.

Alloys comprised of a combination of this recently discovered omega-type $B8_2$ phase and orthorhombic 0 phase are the subject of U.S. Pat. No. 5,190,602 (Bendersky et al.). These alloys exhibit physical characteristics of both the orthorhombic and omega-type phases and possess superior high-temperature strength and stability, and low density. The alloys consist in atomic percent of about 48–52% Ti, about 28–32% Al, and about 16–20% Nb.

Despite the development of these improved alloys, there remains a need for yet more improved alloys. Consequently, it is an object of the present invention to provide a novel Ti aluminide alloy with improved properties. It is a further object of the present invention to provide a Ti aluminide alloy with improved high and room temperature mechanical properties. It is another object of the present invention to provide a high-strength Ti aluminide alloy of lower density and improved corrosion resistance.

The present invention provides for such a Ti aluminide alloy which has improved high and room temperature mechanical properties, low density, and improved corrosion resistance. These and other objects and advantages of the present invention, as well as additional inventive features, will be apparent from the description of the invention provided herein.

BRIEF SUMMARY OF THE INVENTION

The present invention provides for an alloy consisting essentially of titanium, aluminum, niobium, and chromium having a heterophase microstructure comprised of cubic B2, hexagonal $DO_{19}$, omega-type $B8_2$, and, optionally, orthorhombic O phases. Such intermetallic Ti-Al-Nb-Cr alloys consisting in atomic percent of about 48–62% Ti, about 28–32% Al, and about 10–20% combined Nb and Cr. The chromium is preferably present in a concentration in atomic percent of about 4–16% of the total concentration.

The intermetallic Ti-Al-Nb-Cr alloy of the present invention possesses a novel phase microstructure and superior properties as compared to other Ti aluminide alloys, such as the ternary Ti-Al-Nb alloy described above. These superior properties include improved high and room temperature mechanical properties, a decrease in density, and potentially improved corrosion resistance. Such superior properties makes the Ti-Al-Nb-Cr alloys well-suited for industrial, such as aerospace, applications.

DESCRIPTION OF THE PREFERRED EMBODIMENTS

The present invention provides for an alloy consisting essentially of titanium, aluminum, niobium, and chromium having a heterophase microstructure comprised of cubic B2, hexagonal $DO_{19}$, omega-type $B8_2$, and, optionally, orthorhombic O phases.

Such an intermetallic Ti-Al-Nb-Cr alloy consists in atomic percent of about 48–62% Ti, about 28–32% Al, and about 10–20% combined Nb and Cr. The chromium is preferably present in a concentration in atomic percent of about 4–16% of the total concentration. The alloy preferably consists of about 54–62% Ti, about 29–32% Al, about 10–16% combined Nb and Cr, wherein Cr is present at about 4–10% of the total concentration. More preferably, the alloy of the present invention consists of about 58% Ti, about 29.5% Al, about 6.25% Nb, and about 6.25% Cr.

The present inventive alloy is of low density (about 4.55 g/cm$^3$), combines room temperature toughness with very high strength (up to 250 ksi), combines high-temperature (up to 900° C.) strength with microstructural stability, and possesses potentially improved corrosion or oxidation resistance. The properties of the present inventive alloy are believed to be achieved as a result of the unique thermodynamically-stable microstructure of the alloy which consists of three, or possibly (for some compositions) four, intermetallic phases: the hexagonal $DO_{19}$ phase, the omega-type B2 phase, the cubic B2 phase, and possibly the orthorhombic O phase. The presence of these phases in the microstructure of the present inventive alloy imparts to the alloy a particular property. Whereas the close-packed ordered orthorhombic O and hexagonal $DO_{19}$ phases provide the high temperature strength and potentially improved creep resistance of the present inventive alloy, the omega-type $B8_2$ phase provides high temperature microstructural stability and strength, and the cubic B2 phase provides low temperature ductility and toughness. The present inventive alloy employs Cr for stabilizing the B2 structure in the Ti-Al-Nb system.

Although there are examples of other Ti-Al-Nb-Cr alloys in the published literature, the present inventive alloy is quite different from these other alloys. For example, U.S. Pat. Nos. 4,879,092 and 5,076,858 disclose alloys consisting in atomic percent of 42–52% Ti, 46–50% Al, 1–5% Nb, and 1–3% Cr, while U.S. Pat. No. 4,990,308 discloses certain alloys consisting in atomic percent of 32–48% Ti, 8–16% Al, 24–58% Nb, and 2–12% Cr. The present inventive alloy contains less aluminum and higher levels of Nb and Cr than the alloys disclosed in the '092 and '858 patents and contains higher levels of Al and lower levels of Nb than the '308 patent.

Figure 1:
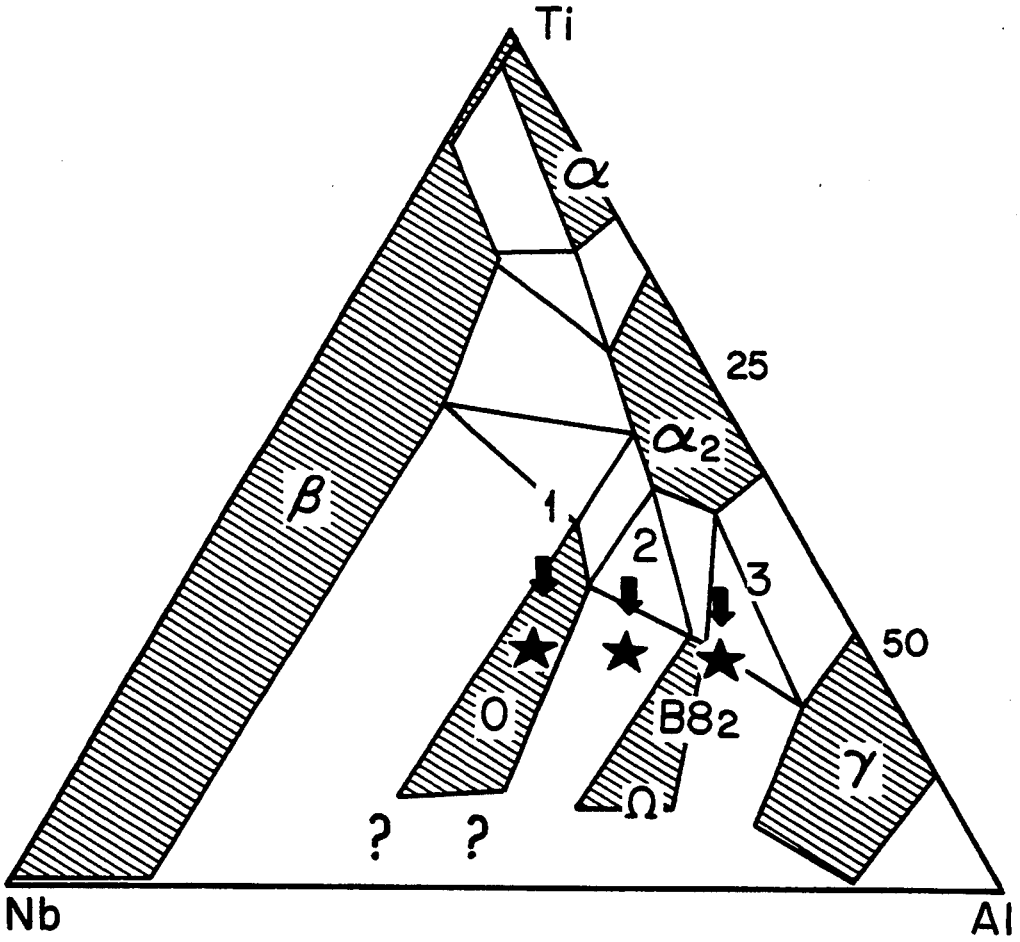
FIG. 1 sets forth a schematic drawing of an isothermal section of the Ti-Al-Nb phase diagram for a preferred alloy of the present invention based on experimental data at 700° C.

The present inventive alloys improve upon these and other alloys. The present inventive alloy possesses low temperature ductility superior to the alloys combining the $B8_2$ and O phases and comparable high temperature strength. This is accomplished in the present inventive alloy by combining the B2 phase with the $B8_2$ and O phases through quaternary alloying. While there is no equilibrium triangle between the B2, $B8_2$ and O phases (FIG. 1), addition of a fourth element known to stabilize a B2 structure brings the B2 phase in thermodynamic equilibrium with the close-packed $DO_{19}$ and O phases and the omega-type $B8_2$ phase. In a field comprised of these four (i.e. B2, $DO_{19}$, O and $B8_2$), or three (i.e. B2, $DO_{19}$ and $B8_2$) phases, a rich variety of microstructures and properties is possible.

The present inventive alloy may be prepared by any suitable process and is preferably prepared by arc-casting, forging (or extrusion), homogenizing (optional), and annealing. The alloy is homogenized through heat-treatment at a suitable temperature, e.g., about 1200° C., to form an alloy having a uniform composition, and subsequently annealed at a suitable temperature, e.g., at about 700–1100° C., preferably at about 700–900° C. Heat-treatment of the alloy at about 700–900° C. establishes the preferred final microstructure and physical properties of the present inventive alloy. Since all four phases which combine to produce high strength composites are structurally related to the BCC structure, a rich variety of semicoherent fine microstructures can be achieved by different cooling and heating schedules (Banerjee et al. *Acta Metall.*, 36, 871 (1988); Bendersky et al. Proc. Mater. Res. Soc. Symp., 133, 45 (1989); Bendersky et al. *Acta Metall.*, 38, 931 (1990)).

The microstructure and physical properties of the present inventive alloy renders it quite attractive for a number of different applications. Specifically, structural components can be prepared from the present inventive alloy, and those structural components will exhibit high strength and high temperature, which are useful in critical applications. The high specific strength and microstructural stability of the alloy at elevated temperatures, combined with its low density, makes it a good candidate for use in preparing components for aerospace applications. For example, the alloy could replace much heavier (8–9 g/cm$^3$) nickel-based superalloys.

Thus, structural components of jet and rocket engines and the like can be prepared from the present inventive alloy with a savings in weight and superior properties. In this capacity, the alloys can find use in a new generation of jet turbines for such parts as disks, blades, and vanes. Another application involves the use of the alloy in structural components which form an aircraft body. The applications of the present inventive alloy, of course, are not limited to aerospace technology. The alloy can be also used as a matrix material for different metal-matrix composites or as a coating on a suitable substrate, such as a metal.

The following examples further illustrate the present invention but, of course, should not be construed as in any way limiting its scope.

EXAMPLE 1

This example illustrates the preparation of a preferred intermetallic Ti-Al-Nb-Cr alloy of the present invention. The alloy consists of about 58% Ti, about 29.5% Al, about 6.25% Nb, and about 6.25% Cr, all in atomic percent concentration based on the total alloy.

Cast buttons of the appropriate Ti, Al, Nb, and Cr materials in the indicated atomic percent concentrations were homogenized at 1300° C. for 3 hours in a vacuum-tight arc melting furnace under two-thirds atmosphere gettered argon. Care was taken to avoid exposure of the hot metal to oxygen because of the strong affinity of titanium for oxygen. Since yttrium has a higher affinity for oxygen and nitrogen, samples were placed on a $Y_2O_3$-coated $Al_2O_3$ substrate during heat-treatment.

Various samples of the homogenized alloy was annealed at temperatures ranging from 700 to 1300° C. Samples which were annealed at temperatures of 1100° C. and higher possessed a structure having a single phase. This phase was identified as the ordered B2 phase. Due to the high ductility of the B2 phase, the alloy could readily be hot worked to a net shape near 1100° C. Samples which were annealed at temperatures of about 700–800° C. possessed an equilibrated microstructure having three, or possibly four, phases.

EXAMPLE 2

This example verifies the microstructure of a preferred intermetallic Ti-Al-Nb-Cr alloy of the present invention prepared in accordance with Example 1. In particular, the alloy consisted of about 58% Ti, about 29.5% Al, about 6.25% Nb, and about 6.25% Cr, all in atomic percent concentration based on the total alloy, and was annealed at 700° C. for 21 days.

The microstructure of the alloy was investigated by transmission electron microscopy (TEM). TEM thin foils were prepared by a standard twin-jet electropolishing procedure carried out at 0° C. This procedure employed an electrolyte consisting of 300 ml methanol, 175 ml N-butanol, and 30 ml $HClO_4$.

The microstructure of the alloy was found to consist of a homogeneous distribution of fine particles in a matrix, as visualized by bright and dark field TEM. Selected area electron diffraction of the alloy revealed reflections belonging to the omega-type $B8_2$ phase, which appeared as round particles in the dark field TEM image, as well as orthorhombic O and/or hexagonal $DO_{19}$ phases, which appeared as elongated particles in the dark field TEM image.

The microstructure of the matrix was verified to be of the cubic B2 phase by selected area and convergent beam electron diffraction. The absence of anti-phase boundaries due to BCC/B2 ordering indicated that the B2 phase was ordered at high temperature, which is an important factor for maintaining high temperature strength. The capacity of the alloy to withstand annealing at 700° C. for 21 days verifies that the microstructure is very resistant to coarsening.

EXAMPLE 3

This example demonstrates the toughness of a preferred intermetallic Ti-Al-Nb-Cr alloy of the present invention prepared in accordance with Example 1. In particular, the alloy consisted of about 58% Ti, about 29.5% Al, about 6.25% Nb, and about 6.25% Cr, all in atomic percent concentration based on the total alloy.

Figure 2:
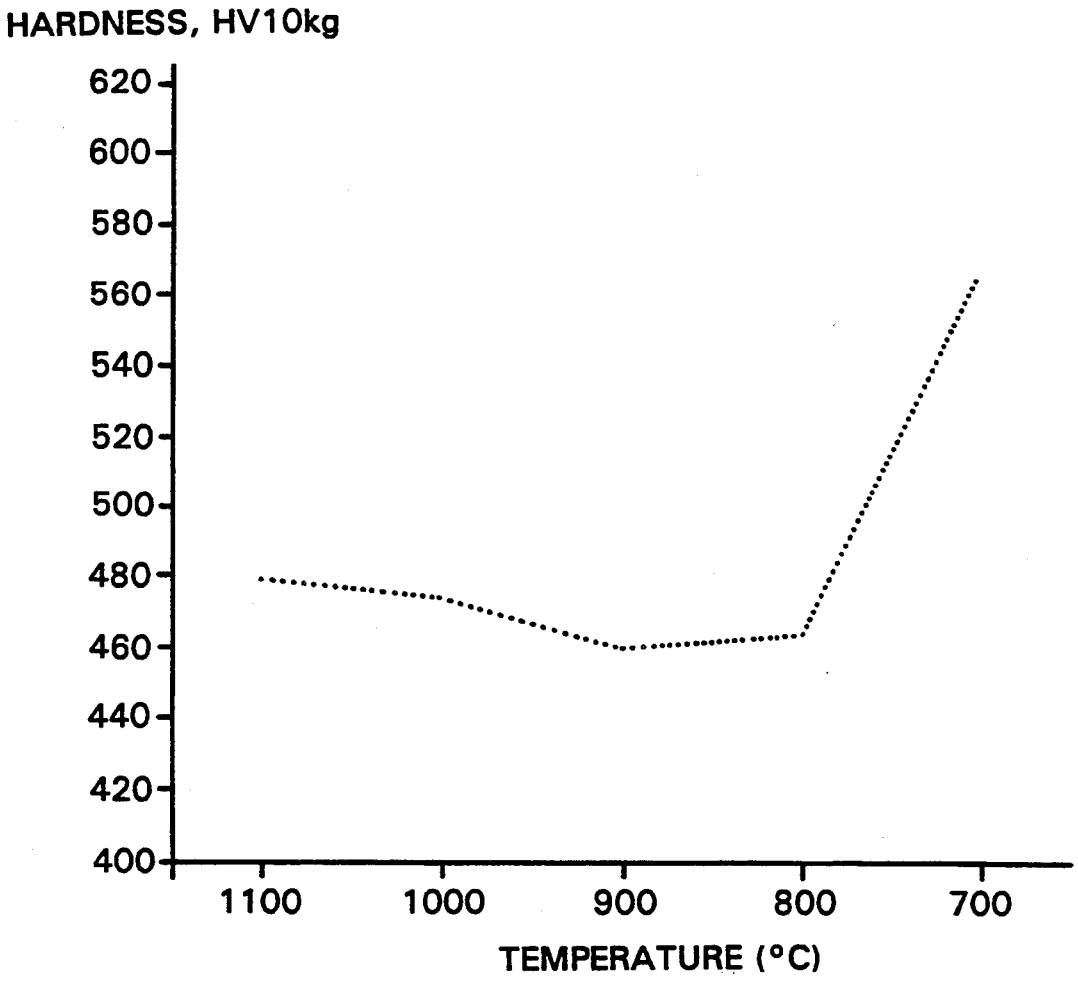
FIG. 2 sets forth a graph of hardness (10 kg load microhardness values) versus heat-treatment temperature (° C.) for a preferred alloy of the present invention.

Microhardness testing was performed on alloy specimens which had been heat-treated at temperatures of 700, 800, 900, 1000, and 1100° C. The alloy specimens were prepared for optical metallography using a diamond pyramid indenter with a 10 kg load. The values of the 10 kg load microhardness testing for an alloy consisting in atomic percent of about 30% Al, about 6.2% Nb, 6.2% Cr, and the balance, titanium, are plotted in the graph of FIG. 2 against the heat-treatment temperatures (° C.). The results illustrate the use of high-temperature strengthening of the intermetallic $Ti_3Al$ alloy by the omega-type brittle phase and ductilization through use of a coexisting cubic B2 phase.

Examination of the indentations for the specimens confirmed an absence of cracking or coarse slip for those specimens heat-treated below 1000° C. This lack of cracking combined with the measured high strength (microhardness) indicates the significant room temperature toughness of the alloy.

EXAMPLE 4

This example confirms the superior high temperature properties of a preferred intermetallic Ti-Al-Nb-Cr alloy of the present invention prepared in accordance with Example 1.

In particular, the present inventive alloy consisted of about 58% Ti, about 29.5% Al, about 6.25% Nb, and about 6.25% Cr, all in atomic percent concentration based on the total alloy. The density of the present inventive alloy was measured at 4.55 g/cm$^3$. The present inventive alloy was compared with a commercial superalloy IN718 and other state-of-the-art Ti aluminide alloys (U.S. Pat. No. 5,032,357).

High temperature compression tests were carried out on the alloys to determine their yield strength at test temperatures ranging from about 425–1050° C. The high temperature properties were measured for the alloys by compression tests performed in a vacuum furnace. The alloys were heat-treated prior to evaluating yield strength as follows: 1200° C. for 3 hours followed by a water quench; and 700° C. for 5 days followed by a water quench.

Figure 3:
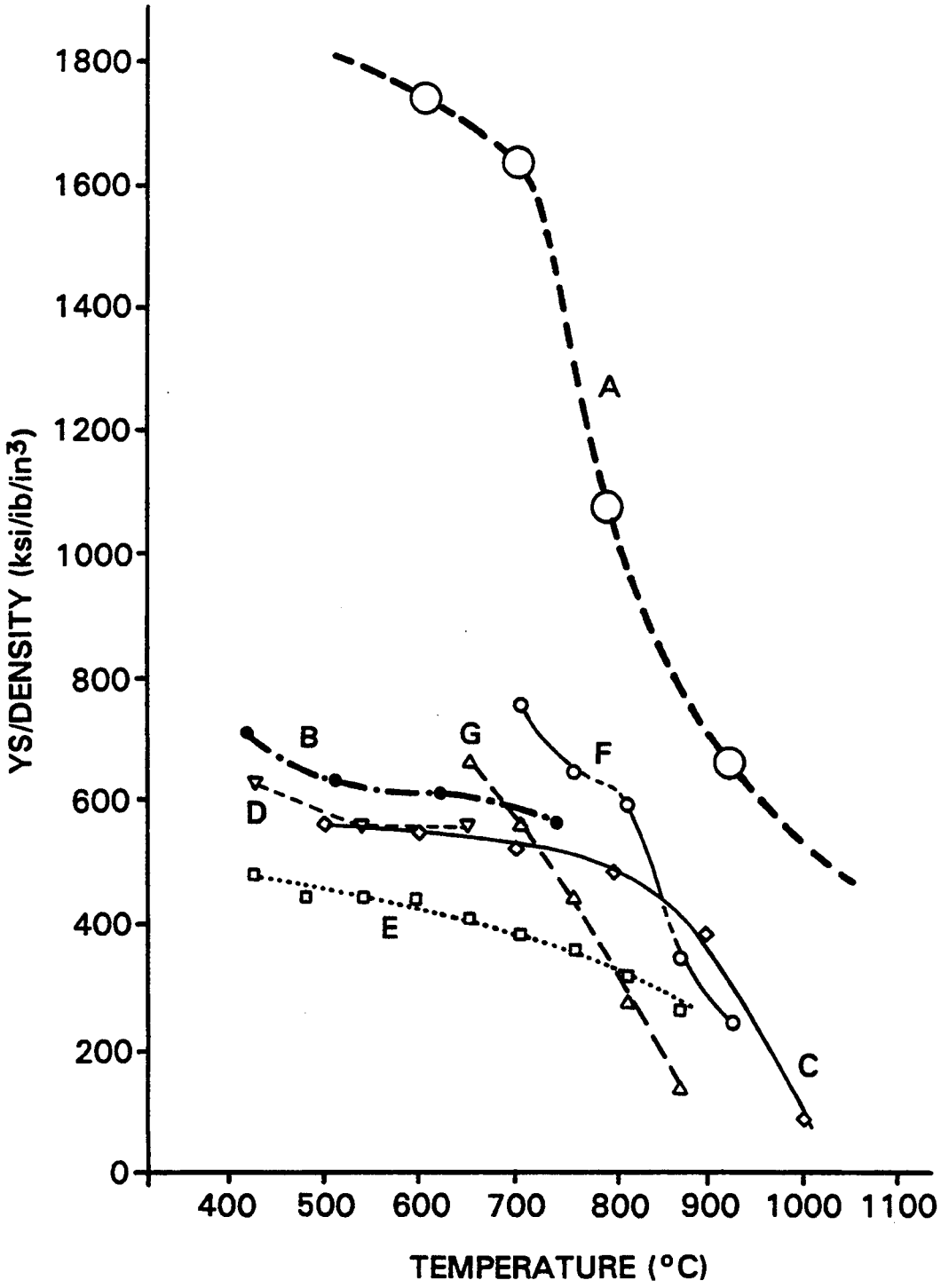
FIG. 3 sets forth a graph of yield strength (0.2% compression yield strength (YS) normalized to density) versus temperature (° C.) for a preferred alloy of the present invention (curve A), as well as of commercial superalloy IN718 (curve B) and other state-of-the-art Ti aluminide alloys (curves C-G).

Results of the high temperature compression tests are presented in the graph of FIG. 3 as 0.2% yield strength (YS) normalized to density of the alloy plotted against test temperature. Results obtained with the present inventive alloy (curve A) are compared in this figure with the commercial superalloy IN718 (curve B) and other state-of-the-art Ti aluminide alloys described in U.S. Pat. No. 5,032,357 consisting of 53% Ti-23% Al-24% Nb (curve C), 61% Ti-25% Al-10% Nb-3% V-1% Mo (curve D), 65% Ti-24% Al-11% Nb (curve E), 47.5% Ti-28.5% Al-24% Nb (curve F), and 51% Ti-22% Al-27% Nb (curve G).

The present inventive alloy exhibits superior yield strength at all tested temperatures. Further, the inventive alloy demonstrates more than twice the specific strength of the other alloys for the important temperature range near 800° C. In view of the structural stability verified for the present inventive alloy at this temperature range, superior creep strength is also anticipated for the alloy.

All of the references (including publications, patents, and patent applications) cited herein are hereby incorporated in their entireties by reference.

While this invention has been described with an emphasis upon preferred embodiments, it will be obvious to those of ordinary skill in the art that variations in the preferred embodiments may be used and that it is intended that the invention may be practiced otherwise than as specifically described herein. Accordingly, this invention includes all modifications encompassed within the spirit and scope of the invention as defined by the following claims.

What is claimed is:

1. An alloy consisting essentially of titanium, aluminum, niobium, and chromium having a heterophase microstructure comprising cubic B2, hexagonal $DO_{19}$, and omega-type $B8_2$.

2. The alloy of claim 1, wherein said alloy has a heterophase microstructure comprising cubic B2, hexagonal $DO_{19}$, omega-type $B8_2$, and orthorhombic O phases.

3. The alloy of claim 1 comprising about 48–62% titanium, about 28–32% aluminum, and about 10–20% combined niobium and chromium in atomic percent.

4. The alloy of claim 1, wherein a homogenized alloy of titanium, aluminum, niobium, and chromium is quenched to a pre-annealing temperature to form an alloy of uniform composition, and is annealed at a predetermined temperature for a predetermined period of time to form the heterophase microstructure.

5. The alloy of claim 2, wherein a homogenized alloy of titanium, aluminum, niobium, and chromium is quenched to a pre-annealing temperature to form an alloy of uniform composition, and is annealed at a predetermined temperature for a predetermined period of time to form the heterophase microstructure.

6. The alloy of claim 3, wherein chromium is present in a concentration in atomic percent of about 4–16% of the total concentration.

7. The alloy of claim 3, wherein titanium is present in a concentration in atomic percent of about 54–62%, aluminum is present in a concentration in atomic percent of about 29–32%, and niobium and chromium are present in a combined concentration in atomic percent of about 10–16%.

8. The alloy of claim 3 consisting essentially of about 58% titanium, about 29.5% aluminum, about 6.25% niobium, and about 6.25% chromium in atomic percent.

9. The alloy of claim 4, wherein said predetermined temperature is from about 700° C. to about 1100° C.

10. The alloy of claim 5, wherein said predetermined temperature is from about 700° C. to about 1100° C.

11. The alloy of claim 7, wherein chromium is present in a concentration in atomic percent of about 4–10% of the total concentration.

12. The alloy of claim 9, wherein said predetermined temperature is from about 700° C. to about 900° C.

13. The alloy of claim 10, wherein said predetermined temperature is from about 700° C. to about 900° C.

14. An alloy consisting essentially of about 48–62% titanium, about 28–32% aluminum, niobium, and chromium, wherein niobium and chromium are present in a combined concentration of about 10–20%, all in atomic percent.

15. The alloy of claim 14, wherein chromium is present in a concentration in atomic percent of about 4–16% of the total concentration.

16. The alloy of claim 14, wherein titanium is present in a concentration in atomic percent of about 54–62%, aluminum is present in a concentration in atomic percent of about 29–32%, and niobium and chromium are present in a combined concentration in atomic percent of about 10–16%.

17. The alloy of claim 14 consisting essentially of about 58% titanium, about 29.5% aluminum, about 6.25% niobium, and about 6.25% chromium in atomic percent.

18. The alloy of claim 14, wherein said alloy has a heterophase microstructure comprising cubic B2, hexagonal $DO_{19}$, omega-type $B8_2$, and orthorhombic O phases.

19. The alloy of claim 16, wherein chromium is present in a concentration in atomic percent of about 4–10% of the total concentration.

* * * * *